United States Patent [19]

Blum

[11] Patent Number: 4,966,498

[45] Date of Patent: Oct. 30, 1990

[54] PILE-FORMING APPARATUS FOR USE IN LOW DENSITY OVERBURDEN

[75] Inventor: Kenneth J. Blum, Kansas City, Mo.

[73] Assignee: Berkel & Company Contractors, Inc., Bonner Springs, Kans.

[21] Appl. No.: 394,552

[22] Filed: Aug. 16, 1989

[51] Int. Cl.[5] ..... E02D 7/24; E02D 5/34

[52] U.S. Cl. ..... 405/233; 405/232; 405/241; 405/248; 175/171

[58] Field of Search ..... 405/233, 236, 240, 241, 405/242, 248, 249, 128, 129, 232, 238, 133, 138; 175/23, 171, 257

[56] References Cited

U.S. PATENT DOCUMENTS

| | | | |
|---|---|---|---|
| 1,570,404 | 1/1926 | Rotinoff | 175/23 X |
| 3,499,293 | 3/1970 | Kato | 405/241 |
| 3,707,848 | 1/1973 | Chelminski | 405/240 X |
| 3,869,003 | 3/1975 | Yamada et al. | 175/171 |
| 4,100,750 | 7/1978 | Labrue | 405/241 |
| 4,637,758 | 1/1987 | Tamaki et al. | 405/248 |

FOREIGN PATENT DOCUMENTS

| | | | |
|---|---|---|---|
| 1030619 | 5/1966 | United Kingdom | 405/233 |

*Primary Examiner*—Randolph A. Reese
*Assistant Examiner*—John Ricci
*Attorney, Agent, or Firm*—Hovey, Williams, Timmons & Collins

[57] ABSTRACT

An improved method and apparatus for the formation of casing assisted grout piles at low density overburden construction sites is provided which includes a collar assembly (44) adapted to be secured to the conventional upright support frame (12) forming a part of typical pile-forming equipment. Preferably, the assembly (44) includes a pair of hingedly interconnected arcuate collar sections (46,48) which cooperatively grip the upper protruding end (42) of an embedded metallic casing (40). The sections (46,48) are provided with circumferentially spaced elongated, gripping elements (70) thereon, as well as a piston and cylinder assembly (60) for selective opening and closing movement of the sections (46,48). Use of the casing-gripping assembly (44) prevents substantial movement or uprooting of the embedded casing (40), and permits pile formation at sites such as landfills containing municipal solid wastes.

9 Claims, 1 Drawing Sheet

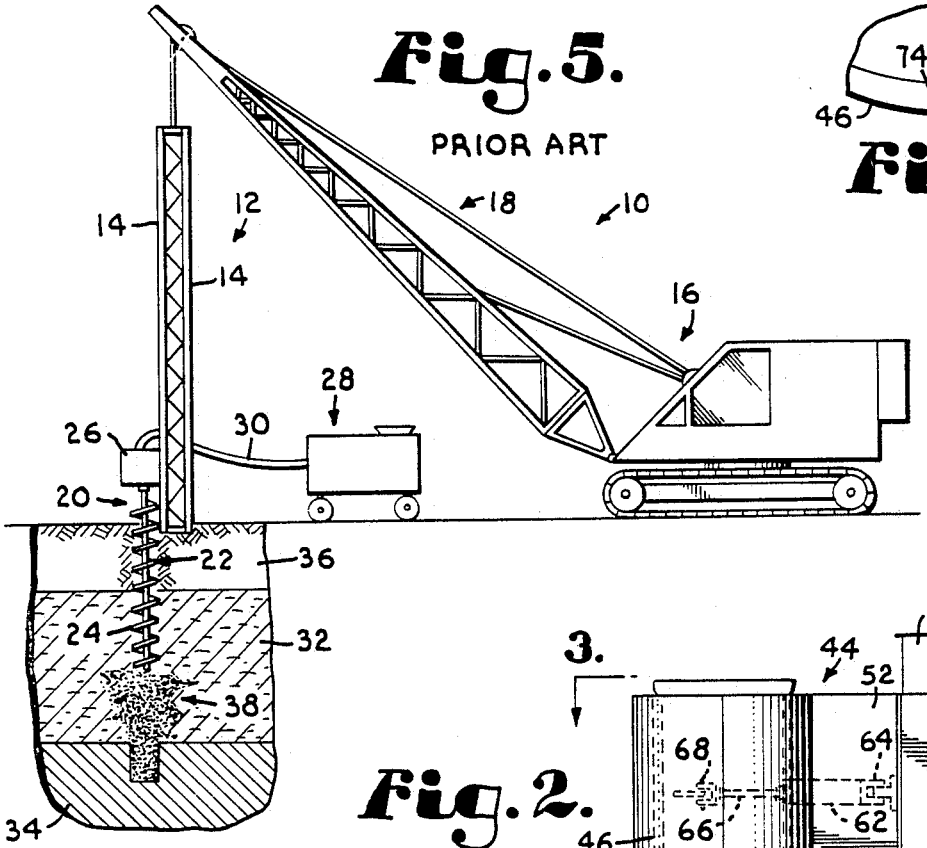
Fig. 5.
PRIOR ART
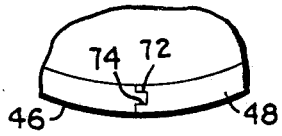
Fig. 4.
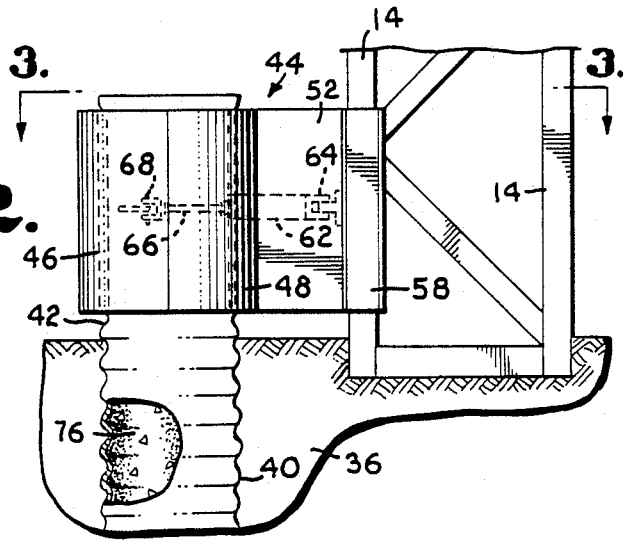
Fig. 2.
Fig. 1.
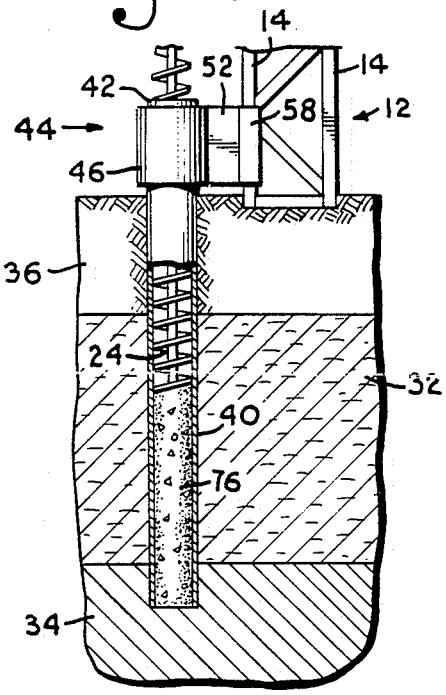
Fig. 3.
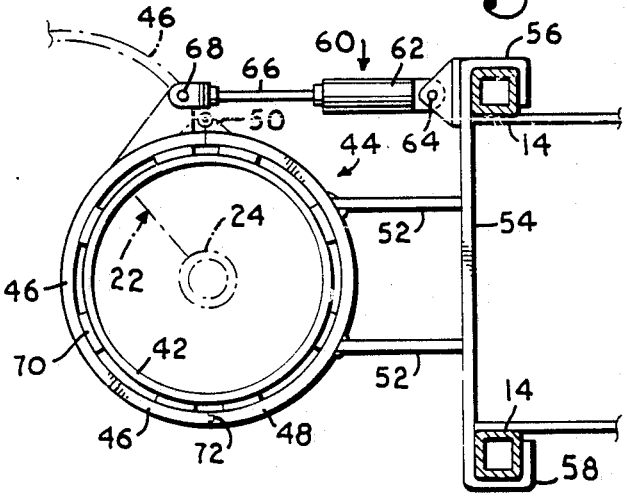

PILE-FORMING APPARATUS FOR USE IN LOW DENSITY OVERBURDEN

BACKGROUND OF THE INVENTION

1. Field of the Invention

The present invention is broadly concerned with an improved method and apparatus for assisting in the formation of grout piles, particularly in situations where low density overburden conditions are encountered, e.g., in landfill sites. More particularly, it is concerned with such a method and apparatus which provides a means for stabilizing and preventing the uprooting of embedded tubular metallic casings used in such pile-forming operations; preferably, a hydraulically actuated casing-gripping collar is provided, which is secured to the upright support frame of an otherwise conventional pile-forming assembly.

2. Description of the Prior Art

One favored method of forming structural piles is through the use of auger pressure grouting techniques. During such operations, an upright metallic support frame is positioned adjacent a pile site and is supported by means of a mobile crane. An auger assembly is associated with the support frame, and includes an elongated, flighted auger having a hollow central shaft, as well as an upper auger motor. A supply of fluid grout is also provided, typically by means of a mobile grout truck, with the grout supply being connected to the auger shaft through a flexible hose. During pile-forming operations, the auger is first shifted downwardly during rotation thereof, so as to screw the auger into the earth. When the auger has reached a desired depth, the auger is withdrawn in order to remove the spoil. Simultaneously, fluid grout is directed under pressure through the auger shaft so as to create the pile.

While this technique is extremely advantageous when creating piles in virgin soil, problems may arise if the overburden in question is loose or of low density. For example, in certain areas of the country landfill sites have been largely exhausted, and is now desired to create waste disposal plants on those sites. Unfortunately, many such landfill sites have a low density overburden consisting of previously deposited municipal solid wastes. In such cases attempts at using the straightforward pile-forming technique described above may lead to excessive consumption of grout, in that as the grout is fed under pressure through the auger shaft, it spreads laterally outwardly through the overburden rather than creating a unified, upright pile.

One response to these difficulties is to employ an upright, tubular metallic casing to confine the grout. This expedient is generally known in the art, and methods have evolved for efficiently placing such casings in the earth. However, it has been discovered that use of casings is not a complete answer to the problem of forming piles in landfill sites, because the piles tend to uproot or turn during the pile-forming operations when the auger moves upwardly and downwardly therein. This problem is particularly acute when use is made of lower cost corrugated metallic, as opposed to the more expensive, heavy metallic straight tubes.

SUMMARY OF THE INVENTION

The present invention overcomes the problems outlined above and provides a greatly improved method and apparatus specifically designed to assist in the formation of grout piles in areas characterized by low density overburden. The invention is particularly intended for situations where use is made of a tubular metallic casing which is embedded into the earth and presents a protruding upper end. Broadly speaking, the invention contemplates use of a collar assembly sized and configured for gripping the upper protruding end of the casing, with the collar being secured against substantial lateral or vertical movement. In this way, pileforming operations can be completed without fear of unduly disturbing the embedded casing.

In preferred embodiments, the casing-gripping collar assembly is in the form of a pair of arcuate, hingedly interconnected arcuate sections which cooperatively present a tubular body. The latter defines an innermost casing-engaging surface having a plurality of elongated, circumferentially spaced yieldable rubber-like grippers thereon. Opening and closing of the casing sections is effected by means of a selectively actuatable piston and cylinder assembly.

The collar assembly is advantageously secured to the upright support frame forming a part of the pile-forming assembly. To this end, an attachment plate is provided having a pair of spaced, opposed, terminal upright sleeves adapted to slidably receive the side frame members of the upright support frame.

In use, the upper protruding end of the casing can be effectively gripped so as to ensure smooth, efficient pile-forming operations. Through use of the present invention, relatively low-cost thin metallic corrugated casings may also be employed.

BRIEF DESCRIPTION OF THE DRAWINGS

FIG. 1 is a fragmentary view with parts broken away for clarity illustrating the casing-gripping collar assembly of the invention, in use during formation of a pile;

FIG. 2 is an enlarged, fragmentary view further illustrating the configuration of the collar assembly;

FIG. 3 is a sectional view taken along the lines of 3—3 of FIG. 2 and depicting further details of the collar assembly;

FIG. 4 is a fragmentary illustrating the interconnection bet the arcuate collar-forming sections; and FIG 5 is a schematic representation of conventional prior art equipment for the formation of auger pressure grouted piles.

DESCRIPTION OF THE PREFERRED EMBODIMENT

Turning now to the drawing, and particularly FIG. 5, conventional pile-forming equipment 10 is illustrated. Such equipment includes an upright, metallic, box-like support frame 12 presenting four elongated side frame members 14. The overall equipment 10 further includes a mobile crane 16 having a boom 18; as illustrated, the crane 16 serves to suspend and at least partially support the support frame 12 (the lower end of the frame 12 is typically embedded into the earth for a short distance (as shown in FIG. 1). An auger assembly 20 also forms a part of the equipment 10, and includes an elongated, flighted auger 22 having a central, upright, hollow shaft 24. The auger 22 is surmounted by a drive motor 26 for selective rotation of the auger. The assembly 20 is mounted for up and down movement relative to support frame 12, as those skilled in the art will readily appreciate. Finally, a mobile grout truck 28 is provided, which is coupled via flexible hose 30 to the upper end of auger shaft 24 for delivery of fluid grout to the latter.

The equipment 10 is illustrated in FIG. 5 adjacent a landfill site. The site presents an overburden 32 of loose, low density municipal solid waste, with lower virgin soil or bedrock region 34 and an earthen cover 36. In such a situation, attempts at creating conventional pressure grouted piles have created significant problems. As illustrated in FIG. 5, auger 22 is first shifted downwardly during rotation of the auger until an appropriate depth is reached. At this point, the auger is withdrawn, while simultaneously grout from truck 28 is fed through line 30 into and through the hollow central shaft 24. However, because of the loose, low density nature of overburden 32, the grout extends laterally outwardly and fails to form a discrete, unified pile. Such lateral "leakage" of grout is depicted at 38 in FIG. 5.

As explained above, straightforward use of an embedded casing fails to adequately solve the difficulties encountered in pile formation where extremely low density overburdens are found. Even though the casing may be initially placed in the loose overburden, the action of the auger tends to uproot or dislodge the casing, thereby defeating its very purpose.

The present invention solves these difficulties, however, and provides a means for securely holding an embedded in place during pile-forming operations. Referring to FIGS. 1–3, it will be seen that a corrugated metallic casing 40 (embedded by methods to be described) extends downwardly through cover 36 and overburden 32 and into the region 34. Moreover, the casing 40 presents a protruding upper end 42 which extends a short distance (e.g., 1–3 feet) above grade.

Pursuant to the present invention, a collar assembly 44 is provided which grips end 42 of casing 40 during pile-forming operations. The assembly 44 includes a pair of upright, arcuate, substantially semicircular sections 46, 48 which are interconnected by means of an upright hinge 50. As best seen in FIG. 3, collar section 48 is stationary, and is provided with a pair of laterally spaced apart, rearwardly extending connection arms 52. The arms 52 are in turn secured to a transverse connection plate 54 provided with a pair of endmost, upright sleeve sections 56, 58. A hydraulic piston and cylinder assembly 60 is operatively connected between connection plate 54 and moveable collar section 46. To this end, the cylinder 62 is pivotally coupled to plate 54 as at 64, whereas the outer bight end of piston rod 66 is pivotally coupled to collar section 46 as at 68.

Referring specifically to FIGS. 2 and 3, it will be observed that the sleeve sections 56, 58 forming a part of connection 54 are oriented for slidably receiving the spaced side frame members 14 nearest casing end 42. In this manner, the entire assembly 44 is held fast against substantial lateral or vertical movement during pile-forming operations. It will further be seen that the moveable collar section 46 is designed to swing open for a sufficient distance to permit the collar sections to cooperatively embrace and grip the protruding casing end 42. In the latter regard, effective gripping engagement with the end 42 is assured by provision of a plurality of elongated, upright, circumferentially spaced, resilient pads 70 affixed to the inner surfaces of the sections 46, 48. Finally, as illustrated in FIG. 4, the ends of the sections 46, 48 remote from hinge 50 are provided with a protruding rib 72 (section 46) and a mating recess 74 (section 48) so as to facilitate interfitting of the sections when in their closed, casing-gripping position.

The use of the apparatus of the invention in pile-forming operations will now be described, in the context of a low density overburden pile site. First, the crane 16 and support frame 12 are moved to a point adjacent the site, with the auger 22 being positioned on the support frame. The auger motor is then actuated and the auger assembly is shifted downwardly into the earth. Such action is continued until the auger reaches a desired depth such as that illustrated in FIG. 1. Typically, the auger depth would extend to a point within the virgin soil or bedrock region 34. At this point bentonite gel-forming material is deposited adjacent the upper end of the auger, while the auger continues to rotate. The flighting of the auger serves to convey the gel-forming material along the length of the auger. Inasmuch as sites of the type described commonly are high in moisture, the bentonite material immediately forms a thick gel in the region surrounding the rotating auger. Of course, if additional moisture is needed, such can be supplied externally.

In any event, the auger is next withdrawn from the site, leaving the gel in place. The gel is of such consistency to temporarily hold the surrounding overburden and soil in place, so as to permit insertion of a metallic casing. Such is accomplished simply by lowering the casing 40 into the gel-filled hole, through the use of crane 16. The casing 40 is lowered into the site, leaving the protruding upper end 42 above grade.

In the next step, the collar assembly 44 is positioned on the side frame members 14 of support frame 12 by sliding the members 14 downwardly into the opposed sleeve sections 56, 58 (see FIG. 3). When so positioned adjacent casing end 42, the collar assembly 44 may be opened by actuation of piston and cylinder assembly 60, whereupon the support frame 12 and attached, opened collar assembly 44 are moved to a location where stationary collar section 48 comes into close contact with end 42. Next, the assembly 60 is actuated so as to close moveable collar section 46 to the FIG. 3 position thereof so that the ends of the sections 46, 48 mate and interconnect. When the sections 46, 48 are closed, the pads 70 come into tight gripping engagement with the casing end 42. An appropriate gripping force is maintained by means of the extended piston and cylinder assembly 60.

With the upper end 42 of the casing 40 secured and gripped as described, the pile-forming operation may proceed without fear of uprooting or substantial movement of the casing. Thus, the auger is then lowered into and along the length of the embedded casing 40 to the original depth point, whereupon the auger is slowly withdrawn. During this withdrawal step, fluid grout 76 is injected through auger shaft 24 in order to fill the casing and form a discrete, upstanding structural pile. After the pile-forming operation is thus completed, the collar section 46 is open and the assembly 44 is detached from the casing end 42.

I claim:

1. In apparatus for the formation of an auger pressure grouted pile using a tubular casing, said casing having a longitudinal axis and a sidewall, said apparatus including an upright support frame adapted to be positioned adjacent the protruding upper end of an embedded tubular casing, a flighted auger having a hollow central shaft, means for first shifting said auger downwardly along said support frame and into said casing while the auger rotates and thereafter for withdrawing said auger from said casing, and means for injecting grout into and through said central shaft for filling said casing, the improvement which comprises casing securement means for holding said casing substantially stationary and against vertical movement and preventing the uprooting of said casing during pile-forming operations, said casing securement means including a collar for gripping said casing below said protruding upper end of said casing and means operatively coupled with said collar for causing the collar to exert a compressive force on said sidewall of said casing transverse to the longitudinal axis of said casing, and means operatively coupling said collar to said support frame, said coupling means further including laterally extending connecting means located at least partially below said upper end of said casing.

2. In apparatus for the formation of auger pressure grouted piles using tubular casings, said apparatus including an upright support frame adapted to be positioned adjacent the protruding upper end of an embedded tubular casing, a flighted auger having a hollow central shaft, means for first shifting said auger downwardly along said support frame and into said casing while the auger rotates and thereafter for withdrawing said auger from said casing, and means for injecting grout into and through said central shaft for filling said casing, the improvement which comprises casing securement means for steadying and preventing the uprooting of said casing during pile-forming operations, said casing securement means including a collar for gripping said protruding upper end of said casing, and means operatively coupling said collar to said support frame, said collar comprising a pair of hingedly interconnected arcuate sections, and means for selectively opening and closing said sections.

3. In apparatus for the formation of auger pressure grouted piles using tubular casings, said apparatus including an upright support frame adapted to be positioned adjacent the protruding upper end of an embedded tubular casing, a flighted auger having a hollow central shaft, means for first shifting said auger downwardly along said support frame and into said casing while the auger rotates and thereafter for withdrawing said auger from said casing, and means for injecting grout into and through said central shaft for filling said casing, the improvement which comprises casing securement means for steadying and preventing the uprooting of said casing during pile-forming operations, said casing securement means including a collar for gripping said protruding upper end of said casing, and means operatively coupling said collar to said support frame, said collar presenting an innermost, casing-engaging surface having a plurality of yieldable gripping elements thereon.

4. In apparatus for the formation of auger pressure grouted piles using tubular casings, said apparatus including an upright support frame adapted to be positioned adjacent the protruding upper end of an embedded tubular casing, a flighted auger having a hollow central shaft, means for first shifting said auger downwardly along said support frame and into said casing while the auger rotates and thereafter for withdrawing said auger from said casing, and means for injecting grout into and through said central shaft for filling said casing, the improvement which comprises casing securement means for steadying and preventing the uprooting of said casing during pile-forming operations, said casing securement means including a collar for gripping said protruding upper end of said casing, and means operatively coupling said collar to said support frame, said support frame including a pair of laterally spaced apart side frame members, said coupling means comprising a pair of sleeves configures to slidably receive said frame members.

5. Apparatus for securing a pile casing having a longitudinal axis and a sidewall in the earth during pile-forming operations, said casing presenting a protruding upper end, said apparatus comprising:

collar means for gripping said casing below said upper protruding end, thereof, there being means operatively coupled with said collar means for causing the collar means to exert a compressive force on said sidewall of said casing transverse to the longitudinal axis of said casing; and means operatively coupled with said collar means for holding said collar substantially stationary and preventing substantial vertical movement of said collar means during gripping of siad casing.

6. Apparatus for securing a pile casing in the earth during pile-forming operations, said casing presenting a protruding upper end, said apparatus comprising:

collar means for gripping said upper protruding end of said casing; and means operatively coupled with said collar means for preventing substantial movement of said collar means during gripping of said casing, said collar means comprising a pair of hingedly interconnected arcuate sections, and means for selectively opening and closing of said sections.

7. Apparatus for securing a pile casing in the earth during pile-forming operations, said casing presenting a protruding upper end, said apparatus comprising:

collar means for gripping said upper protruding end of said casing; and means operatively coupled with said collar means for preventing substantial movement of said collar means during gripping of said casing, said collar means presenting an inner, casing-engaging surface having a plurality of yieldable casing-engaging elements thereon.

8. Apparatus for securing a pile casing in the earth during pile-forming operations, said casing presenting a protruding upper end, said apparatus comprising:

collar means for gripping said upper protruding end of said casing; and means operatively coupled with said collar means for preventing substantial movement of said collar means during gripping of said casing, said collar coupling means including a pair of sleeves adapted to slidably receive the side frame members of an upright pile-forming support frame.

9. In a method of forming an auger pressure grouted pile through the use of a tubular casing having a longitudinal axis and a sidewall embedded in the earth and presenting a protruding upper end, said method including the steps of shifting a flighted auger downwardly into and along the length of said casing while rotating the auger, and thereafter withdrawing the auger and filling the casing with grout to form a pile, the improvement which comprises securing said casing against substantial movement or vertical uprooting thereof during pile-forming operations, said casing-securing step comprising the step of gripping said casing below the upper protruding end thereof during movement of said auger therein, and, exerting a compressive force on said sidewall of said casing below the upper end of the casing and transverse to the longitudinal axis of said casing.

* * * * *